US005769923A

United States Patent [19]

Nishikawa et al.

[11] Patent Number: 5,769,923

[45] Date of Patent: Jun. 23, 1998

[54] DECARBURIZATION REFINING PROCESS FOR CHROMIUM-CONTAINING MOLTEN METAL AND ASSOCIATED TOP BLOWING LANCE

[75] Inventors: Hiroshi Nishikawa; Masaru Washio; Tomomichi Terabatake; Akihito Hirota; Naoki Kikuchi, all of Chiba, Japan

[73] Assignee: Kawasaki Steel Corporation, Japan

[21] Appl. No.: 680,782

[22] Filed: Jul. 16, 1996

[30] Foreign Application Priority Data

Jul. 27, 1995 [JP] Japan ..... 7-191984

[51] Int. Cl.[6] ..... C21C 5/30

[52] U.S. Cl. ..... 75/553; 266/225

[58] Field of Search ..... 75/553; 266/265, 266/268, 225

[56] References Cited

U.S. PATENT DOCUMENTS 3,338,570 8/1967 Zimmer ..... 266/225

4,324,584 4/1982 Marizy ..... 75/553

FOREIGN PATENT DOCUMENTS 0 160 374 A3 11/1985 European Pat. Off. .

56 392 10/1968 Luxembourg .

872368 7/1961 United Kingdom .

*Primary Examiner*—Scott Kastler

*Attorney, Agent, or Firm*—Austin R. Miller

[57] ABSTRACT

Method and top blowing lance for decarburization refining chromium molten ferrous metal in which dust formation and chromium loss due to oxidation are suppressed and high productivity is achieved. Decarburization of molten ferrous metal is achieved by blowing gaseous oxygen into the molten metal in a refining furnace provided with a top blowing lance having a plurality of gas blowing nozzles at the tip of the lance. The gas blowing nozzles include at least one sub-nozzle provided at or near the lance axis and a plurality of main nozzles at an outer section of the lance. Blowing refining is carried out with oxygen flow from a plurality of the main nozzles at a flow rate higher than that from the sub-nozzle(s), when the carbon content in the molten metal is about 1 wt % or more.

6 Claims, 4 Drawing Sheets

DECARBURIZATION REFINING PROCESS FOR CHROMIUM-CONTAINING MOLTEN METAL AND ASSOCIATED TOP BLOWING LANCE

BACKGROUND OF THE INVENTION

1. Field of the Invention

The present invention relates to a blown oxygen decarburization refining process for molten ferrous metal containing chromium, and further relates to a top blowing lance used in the process. In particular, the present invention relates to metal refining blown oxygen technology in which oxygen is blown at a high rate to effect decarburization of molten metal containing chromium and which reduces dust formation and chromium loss due to oxidation while maintaining a high rate of productivity.

2. Description of the Related Art

The process is conducted in a refining furnace, such as an AOD furnace. In order to increase productivity of molten metal containing chromium, such as molten stainless steel, it is important to be able to shorten the refining process time.

It has heretofore been thought that an increased blowing rate of oxygen is effective to reduce refining time. Accordingly, decarburization has heretofore been carried out with converters, such as top blowing converters or top-and-bottom blowing converters, each having an oxygen blowing rate that is higher than that in the AOD furnace. Alternatively, reduction of refining time has been attempted with an AOD furnace provided with a top blowing lance to increase the oxygen blowing rate.

An increased oxygen blowing rate, however, produces dust formation and increased chromium loss due to oxidation. This is because a higher oxygen blowing rate is required since the carbon content in the molten steel is relatively high at the time of the initial blowing-refining step. This causes a large amount of dust to spatter. Further, since the temperature of the molten metal is relatively low and scraps are used in converters, the chromium is readily oxidized.

In Japanese Examined Patent No. 2-43803 a refining process is disclosed which has the purpose of decreasing chromium loss due to oxidation. Refining gas is top-blown on the bath surface or into the bath from a lance. The refining gas substantially consists of oxygen when the carbon content in the bath is 1% or more, but consists of a mixture of oxygen and an inert gas when the carbon content in the bath is less than 1%. Further, the inert gas is injected at a low blowing rate into the molten bath and the ratio of oxygen to the inert gas is varied in response to the carbon content in the bath. Such a top blowing lance is designed for a specified gas blowing rate and gas penetration into the molten metal bath, and is mainly used for decarburization. Although this method enables some reduction of chromium loss due to oxidation, excessive chromium loss cannot be prevented when the carbon content exceeds 1% in the molten bath. Actually, if the oxygen blowing rate is increased when the carbon content of the molten bath exceeds 1%, chromium loss due to oxidation unexpectedly increases.

Japanese Examined Patent No. 59-21367 discloses a process for completely burning gaseous carbon monoxide, formed from the metal bath surface, to carbon dioxide. Pure oxygen or an oxygen-containing gas is blown upon the metal bath surface. The top oxygen blowing rate in such a process is merely 0.2 times as much as the bottom oxygen blowing rate, and at host 1.2 times as an upper limit, since the top blowing oxygen is intended mainly to enhance carbon monoxide combustion. Thus, the process can be somewhat effective to decrease chromium loss due to oxidation, but then fails to increase productivity in view of the low oxygen blowing rate.

A top blowing lance for simultaneous decarburization and combustion of carbon monoxide is disclosed in Japanese Examined Utility Model No. 5-12271. The top blowing lance has a main nozzle for decarburization and a plurality of surrounding sub-nozzles having an in-line configuration for secondary combustion. The tilt angle of the main nozzle, i.e., the angle between the main nozzle axis and the lance axis, is necessarily small because the main nozzle is surrounded by sub-nozzles. As a result, the oxygen jet collision rate to the molten steel increases and dust formation accordingly increases. Moreover, the heat of secondary combustion is readily transferred to the side wall bricks and furnace life is shortened due to brick damage.

Japanese Laid-Open Patent No. 1-132714 discloses a method for refining stainless steel by oxygen blowing with a lance having a plurality of nozzles. Because oxygen and non-oxidizing gases are, however, blown onto the bath surface at the same time, it is difficult to achieve decarburization promotion by raising the oxygen blowing rate and concurrently to achieve reduction of chromium loss due to oxidation by raising the temperature of the molten metal as a result of carbon monoxide gas combustion.

SUMMARY OF THE INVENTION

It is an object of the present invention to provide a method for decarburization refining of molten metal containing chromium, and to provide a top blowing lance for carrying out such a refining method, in which dust formation and chromium loss due to oxidation are reduced, and in which increased productivity is achieved.

Another object is to achieve improvement of secondary combustion of carbon monoxide gas formed from the molten metal during the refining process.

It has now been discovered that such problems are overcome by using a top blowing lance having a new and advantageous nozzle design in which the positions of the gas blowing nozzles of the lance are especially advantageous for decarburization and secondary combustion, and by performing the process step of decarburization of the molten metal while raising the metal temperature.

The present invention provides a process for decarburization refining of molten ferrous metal containing chromium comprising blowing gaseous oxygen onto or into the molten metal with a top blowing lance having a plurality of gas blowing nozzles at the tip of the lance. The gas blowing nozzles include at least one sub-nozzle of limited blowing capacity positioned at or near the lance axis and a plurality of main nozzles having greater blowing capacity than the sub-nozzle, arranged to substantially surround the sub-nozzle and preferably arrayed around an outer portion of the lance. When the carbon content in the molten metal is about 1 wt % or more, refining is carried out by controlling the rate of oxygen flow from a plurality of main nozzles at a flow rate higher than that from the sub-nozzle(s). Oxygen from the sub-nozzle(s) is accordingly directed within a shroud formed by flows from the main nozzles and is thereby directed for combustion of carbon monoxide gas formed from the molten metal. Concurrently the oxygen from the main nozzles is primarily directed upon or into the bath for decarburization of the molten metal. Additionally, when the carbon content of the molten metal in the bath is about 1 wt % or more, the temperature of the molten metal is controlled to at least about 1,650° C.

The top blowing lance comprises a plurality of gas blowing nozzles at its tip, with at least one sub-nozzle at or near the lance axis and arranged to blow oxygen for combustion of carbon monoxide gas formed from the molten metal. A plurality of main nozzles are provided at outer locations on the lance so as to surround the sub-nozzle to blow oxygen for effecting decarburization.

It is important that the total cross-sectional area of the throat portion of the sub-nozzle is from about 3% to about 30% of the total cross-sectional area of the throat portions of all of the nozzles. Each main nozzle may be an angularly divergent nozzle, with an angle between the lance axis and the nozzle axis, and each sub-nozzle an in-line or divergent nozzle having a divergence angle less than that of the main nozzle.

This invention will further be described with reference to specific forms of the process and of the lance, as shown in the appended drawings. The detailed description and the drawings are not intended to limit the scope of the invention, which is defined in the appended claims.

DETAILED DESCRIPTION OF THE PREFERRED EMBODIMENTS

Dust formation increases with increased collision speed of the oxygen jet onto or into the molten metal surface. In a conventional blowing method, the oxygen gas rate is inherently at a maximum along the lance axis, and decreases toward the lance periphery. In contrast, in the present invention, the main nozzles which effect decarburization are positioned at outer sections of the lance, preferably at a distance as far as possible from the lance axis, and having wide nozzle tilt angles thereby decreasing the effective collision speed of the oxygen jet with the molten metal. However, at least one sub-nozzle of smaller capacity is provided on the lance to effect secondary combustion, thus reducing effective oxygen flow velocity at or near the lance axis. In this way dust formation is very effectively reduced.

Moreover, when a plurality of main nozzles are provided in an area spaced around an internally-located sub-nozzle, the heat due to secondary combustion, which is generated at or near the lance axis, is shielded by the jets from the surrounding main nozzles, reducing or preventing transfer of secondary combustion reaction heat to the side wall of the furnace. Thus, the molten metal is effectively centrally heated so that chromium loss due to oxidation is suppressed while preventing or minimizing damage of the side wall of the furnace due to secondary combustion heat, resulting in significantly prolonged furnace life.

Figure 1:
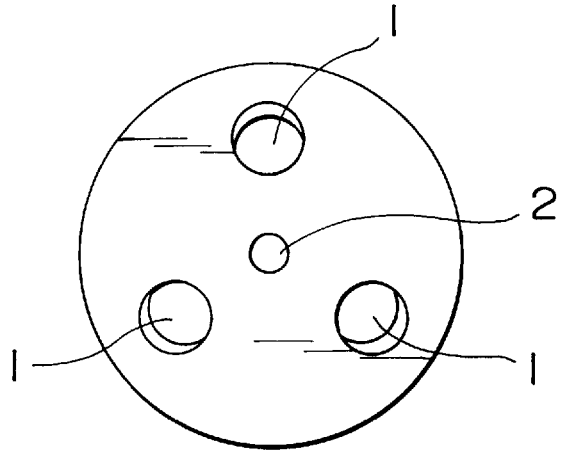
FIG. 1 shows an embodiment of an arrangement of lance nozzles in accordance with one embodiment of the present invention.
Figure 2:
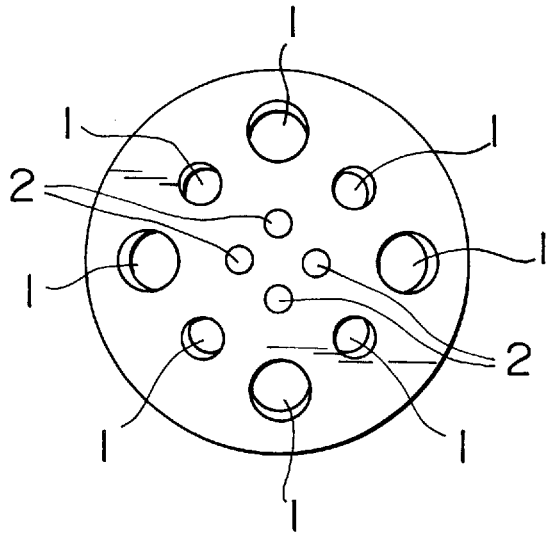
FIG. 2 shows another embodiment of an arrangement of lance nozzles in accordance with the present invention.
Figure 7:
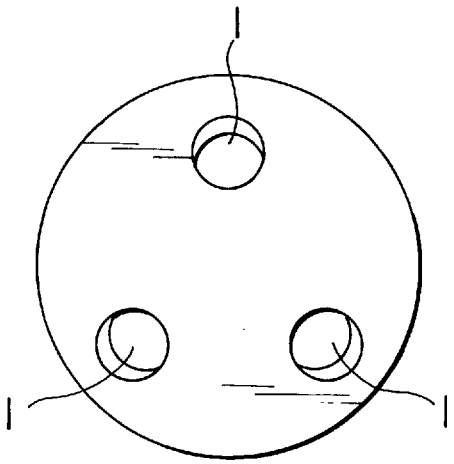
FIG. 7 shows an arrangement of nozzles of a comparative top blowing lance used for ordinary converter operations.

The conventional lance of FIG. 7 has three relatively large main nozzles 1 which blow refining gas for decarburization, whereas this invention as exemplified by FIGS. 1 and 2 provides at least one significantly smaller sub-nozzle 2 for blowing gas to raise the molten metal temperature by secondary combustion of carbon monoxide from the molten metal. This happens at the lance axis (as in FIG. 1) or near the lance axis (as in FIG. 2). The main nozzles 1 blow refining gas for decarburizing the molten metal; they effectively surround the sub-nozzle(s) 2. In contrast, the comparative lance of FIG. 3 is provided with an axially located main nozzle 1 for effecting decarburization, and a plurality of outwardly positioned sub-nozzles 2 for secondary combustion, and fails to achieve the objects or advantages of this invention.

EXAMPLE 1

As an example of this invention, 100 tons of molten steel containing 5.5% of carbon and 16% of chromium were charged into a converter provided with a top blowing lance, and the molten steel was decarburized while oxygen gas was blown from three main nozzles and a sub-nozzle arranged according to FIG. 1 until the carbon content of the steel was reduced to 1%. Oxygen gas from the sub-nozzle 2 was directed to cause secondary combustion of carbon monoxide gas formed from the molten metal. The refining conditions included a top blowing oxygen rate of 250 $Nm^3$/min. (200 $Nm^3$/min. from the main nozzles and 50 $Nm^3$/min. from the sub-nozzle) and a lance height of 1.8 m. The main nozzles 1 were angled outwardly away from the axis as shown in FIG. 1, and the sub-nozzle 2 was axis-oriented. For comparison, operations were carried out using the conventional lance in FIG. 7 and the comparative lance in FIG. 3.

Figure 3:
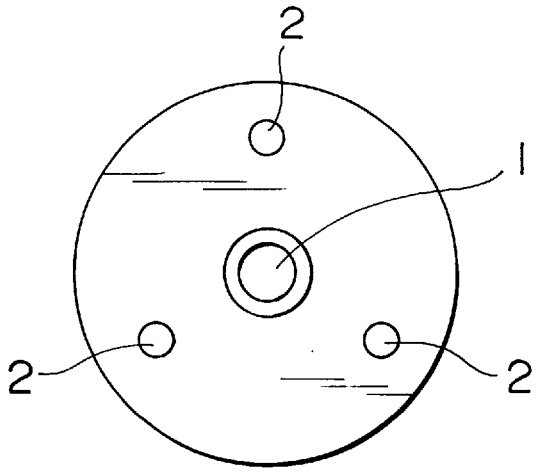
FIG. 3 shows a comparative example of an arrangement of lance nozzles outside the scope of the present invention.

As a result, dust was created in an amount of 13 kg/t during decarburization while using the lance of FIG. 1, while 32 kg/t of dust were formed with use of the conventional lance of FIG. 7 and 48 kg/t in the use of the comparative lance of FIG. 3. These results factually demonstrated that the decarburization method and lance in accordance with the present invention significantly decreased dust formation, all other parameters having been kept constant.

Figure 4:
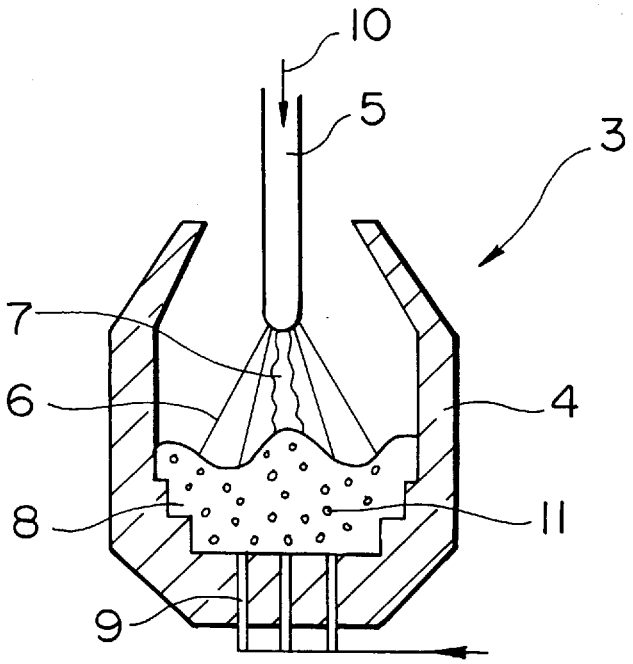
FIG. 4 is a schematic view illustrating one form of blowing-refining process according to this invention, when decarburization of molten metal containing chromium is carried out in a top and bottom blowing converter.

The decarburization-refining method in accordance with this invention may be applied to decarburization refining of molten steel containing chromium in a top and bottom blowing converter as shown in FIG. 4. A top blowing lance 5 as shown in FIG. 1 is shown in FIG. 4. Pure oxygen gas 10 was blown into the bath and on the bath surface from the top blowing lance 5 and from a bottom blowing tuyere 9 to cause the decarbonization reaction $C+\frac{1}{2}O_2 \rightarrow CO$ for forming carbon monoxide bubbles 11 in the molten metal. The carbon monoxide bubbles 11 caused secondary combustion with oxygen injected from the sub-nozzle 2 at or near the axis of the top blowing lance 5, according to the reaction $CO+\frac{1}{2}O_2 \rightarrow CO_2$. Because the secondary combustion region 7 of FIG. 4 was surrounded by a shroud of oxygen jets 6 injected from a plurality of main nozzles 1 of the top blowing lance 5, the heat formed from the secondary combustion reaction was not accumulated in the body 4 of the converter. This is because of formation of a thermal barrier or curtain effect of the surrounding oxygen jets 6. As a result, secondary combustion heat was effectively transferred primarily directly into the molten metal 8, with the beneficial result that furnace walls were protected while concurrently chromium loss due to oxidation was significantly reduced.

At least three main nozzles 1 must be provided in order to achieve these effects in accordance with the present invention. Further, it is preferable that pure oxygen gas is blown from the bottom blowing tuyeres 9 and the top blowing lance when the carbon content of the molten metal is about 1% or more; this maximizes the decarburization rate. On the other hand, when the carbon content of the molten metal is about 1% or less, chromium loss due to oxidation may be reduced by diluting oxygen with an inert gas or by decreasing the oxygen blowing rate during refining.

The method in accordance with the present invention is effectively applicable to the use of an increase of oxygen blowing rate. This allows increasing the decarburization rate as much as possible when the carbon content in the molten bath is about 1% or more. Such a process can be appropriately carried out within the range of carbon contents set forth above, to achieve a targeted blowing-refining time.

An excessively high oxygen blowing rate from the sub-nozzle(s) 2 tends to decrease the quantity of oxygen gas which contributes to the decarburization, and tends to inhibit decarburization. In contrast, an excessively low oxygen blowing rate inhibits the secondary combustion that promotes oxidation of chromium; this is due to decreased reaction heat transfer into the molten steel, and tends toward inhibited decarburization. Thus, it is preferable to control the process within an important ratio range of the blowing rates of the sub-nozzle(s) 2 to the blowing rates of the main nozzles 1 as represented by the respective throat cross-sectional areas, since at constant oxygen feed pressure each flow rate is proportional to the throat cross-sectional area.

Figure 5:
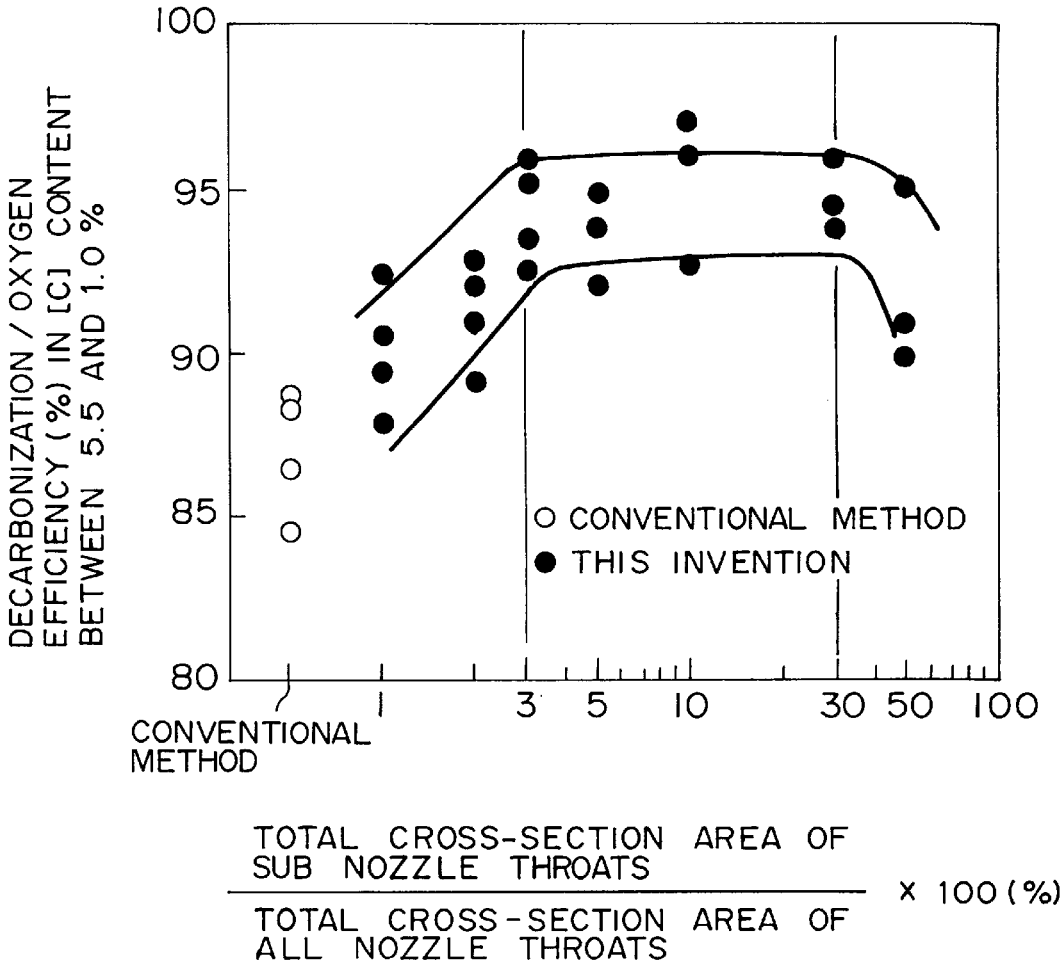
FIG. 5 is a graph illustrating the correlation according to one form of this invention between the decarburization/oxygen efficiency when the carbon content of the molten metal is reduced from 5.5% to 1.0%, plotted against the ratio of the total cross-sectional areas of sub-nozzles used to the total cross-sectional areas of all the nozzles used.

FIG. 5 is a graph illustrating the correlation of throat ratio, i.e., the ratio of the total throat cross-sectional areas of all the nozzles 1 to the total throat cross-sectional areas of the sub-nozzle(s) 2.

FIG. 5 shows decarburization oxygen effects obtained for molten steel containing 5.5% of carbon and 16.0% of chromium when subjected to decarburization refining until the carbon content is reduced to 1.0%, using a lance as shown in FIG. 1. FIG. 5 demonstrates that the decarburization method in accordance with the present invention was significantly effective in the throat ratio range of about 3% to 30%, in particular, compared with results according to the conventional method. Indeed, the decarburization/oxygen efficiency in accordance with the present invention is factually shown to have been improved over the entire throat ratio range.

It is preferable that each main nozzle is a divergently angled nozzle relative to the lance axis and that each sub-nozzle is a generally axially-arranged nozzle, or even has a somewhat divergent angle having a divergence angle relative to the lance axis less than that of the main nozzles.

Figure 6:
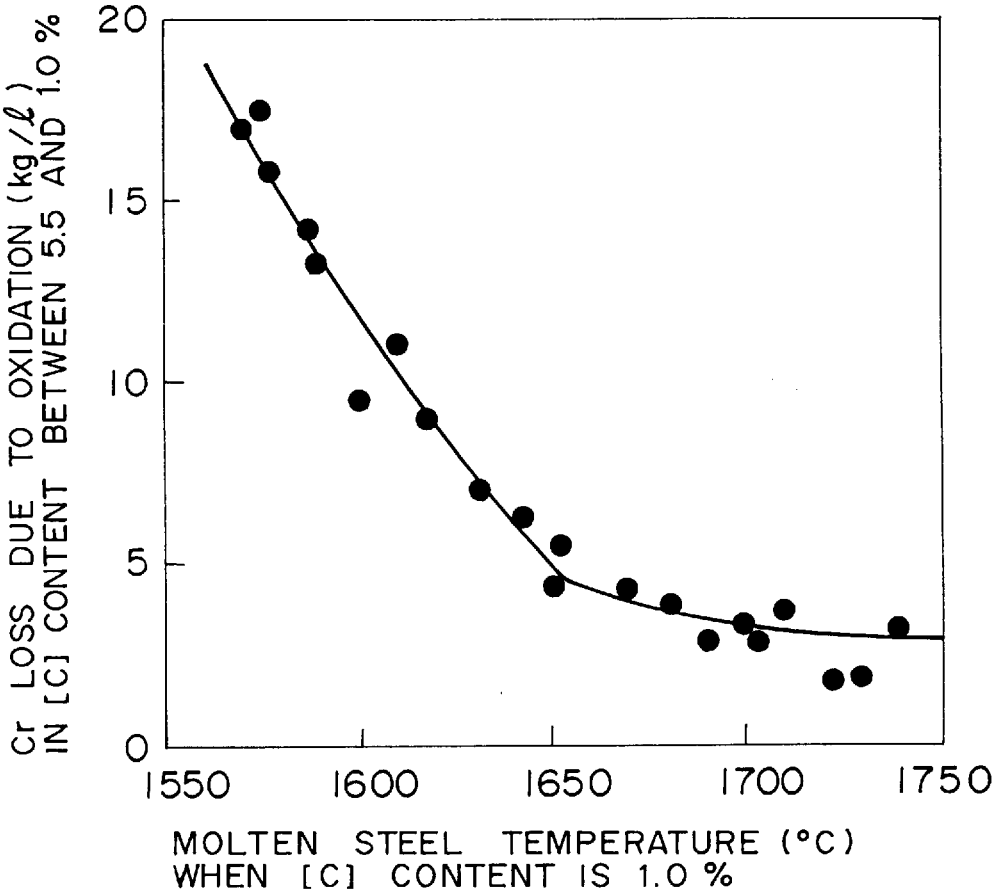
FIG. 6 is a graph illustrating the correlation between chromium loss due to oxidation when the carbon content in the molten steel is reduced from 5.5% to 1.0%, plotted against temperature of the molten steel as it exists when the carbon percentage is 1.0%.

FIG. 6 is a graph illustrating a correlation found between chromium loss due to oxidation and molten steel temperature at a carbon content of 1.0% when molten steel containing 5.5% of carbon and 16.0% chromium was subjected to decarburization-refining until the carbon content was reduced to 1.0% using a lance in accordance with the present invention. The lance had divergent main nozzles and longitudinally oriented sub-nozzles, and the total throat cross-sectional areas were 20% of the lance area. FIG. 6 indicates that chromium loss due to oxidation was reduced when the molten steel temperature was preferably controlled to about 1,650° C. or more at a carbon content of about 1.0%.

Further Examples

After 100 tons of a molten steel containing 5.5% of carbon and 16.0% of chromium was charged into a top and bottom blowing converter, a decarburization refining operation in accordance with the present invention, in comparison with a conventional method was carried out under the conditions as shown in Table 1, in which the lance height was 1.8 m. The bottom blowing gas was a gaseous mixture comprising oxygen and nitrogen (1:1), the top blowing gas was oxygen except for the oxygen blowing range for blowing only oxygen in Table 1, and the blowing rate was 150 $Nm^3$/min. for a carbon content of 0.6% or more, or 120 $Nm^3$/min. for a carbon content of 0.6 to cessation of blowing or 0.05%.

Table 2 summarizes the operational results. Table 2 demonstrates that the decarburization method in accordance with the present invention materially shortened the blowing time during decarburization, decreased the chromium loss due to oxidation, and reduced the dust formation, all at the same time.

TABLE 1

| No. | Heat Size (tons) | Top Blowing Lance Configuration | Cross Sectional Area of Sub-nozzle (%) | Main Nozzle(upper) Sub-nozzle(lower) Angle to the Longitudinal Axis | Oxygen Blowing Rate ($Nm^3$/min) Top Blowing | Oxygen Blowing Rate ($Nm^3$/min) Bottom Blowing | [C] concentration Range of Oxygen Blowing (%) | Amount of Scrap Used (t) | Bath including Cr Temperature (C.°) | Molten Steel Temperature at [C] = 1% (C.°) |
|---|---|---|---|---|---|---|---|---|---|---|
| | | | | | (1) This Invention | | | | | |
| 1 | 105 | FIG. 2 | 20 | Divergent<br>Straight | Main Nozzle 200<br>Sub-nozzle 50 | 70 | 5.5–1.0 | 15.0 | 1358 | 1720 |
| 2 | 103 | FIG. 2 | 35 | Divergent<br>Divergent | Main nozzle 162.5<br>Sub-nozzle 87.5 | 70 | 5.5–2.5 | 10.0 | 1310 | 1648 |
| 3 | 108 | FIG. 1 | 12.5 | Divergent<br>Straight | Main Nozzle 218.7<br>Sub-nozzle 31.3 | 70 | 5.5–1.3 | 5.0 | 1330 | 1645 |

TABLE 1-continued

| No. | Heat Size (tons) | Top Blowing Lance Configuration | Cross Sectional Area of Sub-nozzle (%) | Main Nozzle(upper) Sub-nozzle(lower) Angle to the Longitudinal Axis | Oxygen Blowing Rate ($Nm^3$/min) Top Blowing | Oxygen Blowing Rate ($Nm^3$/min) Bottom Blowing | [C] concentration Range of Oxygen Blowing (%) | Amount of Scrap Used (t) | Bath including Cr Temperature (C.°) | Molten Steel Temperature at [C] = 1% (C.°) |
|---|---|---|---|---|---|---|---|---|---|---|
| | | | | | (2) Conventional method | | | | | |
| 4 | 110 | FIG. 7 | — | Divergent — | 250 | 70 | 5.5–1.0 | 15.0 | 1335 | 1635 |
| 5 | 107 | FIG. 3 | 30 | Divergent Straight | Main nozzle 175 Sub-nozzle 75 | 70 | 5.5–1.0 | 10.0 | 1301 | 1620 |
| 6 | 102 | FIG. 7 | — | Divergent | 250 | 70 | 0.9–0.4 | 10.0 | 1325 | 1590 |

TABLE 2

| | No. | Decarburization/Oxygen Efficiency in [C] Concentration Range in Table 1 % | kg/t | Blowing time from [C]: 5.5% to [C]: 0.05% (minutes) | Dust Formation between [C]: 5.5% and [C]: 1.0% (kg/t) | Secondary Combustion Rate between [C]: 5.5% and [C]: 1.0% (%) | Damage Rate of Converter Wall |
|---|---|---|---|---|---|---|---|
| This invention | 1 | 97 | 3.2 | 65 | 12 | 37 | 0.4 mm/CH* |
| | 2 | 92 | 4.5 | 66 | 16 | 26 | 0.3 mm/CH |
| | 3 | 94 | 6.8 | 65 | 14 | 24 | 0.3 mm/CH |
| Conventional method | 4 | 85 | 12.5 | 68 | 35 | 12 | 0.7 mm/CH |
| | 5 | 52 | 18.6 | 83 | 48 | 48 | 3.5 mm/CH |
| | 6 | 45 | 20.1 | 82 | 27 | 18 | 0.6 mm/CH |

*CH represents Charge.

Although this invention has been described with respect to specific forms of the invention, it will be appreciated that many variations may be made. The molten ferrous metal in the bath may have various compositions or additives depending upon intended ultimate use. The reference to blowing oxygen is intended to include other gases containing oxygen, and the blowing rates of the gases may be varied not only by throat diameter changes but by other known means, including feed pressure variations. Further, where reference is made to the main nozzles surrounding the sub-nozzle or sub-nozzles, advantages can be obtained without requiring complete containment or enclosure of the sub-nozzle and provision of only three main nozzles is in most cases sufficient to achieve the benefit of protecting against furnace wall wear.

Other variations and modifications will readily become apparent, including substitution of equivalents, reversals of method steps, and the use of certain features independently of others, all without departing from the spirit and scope of the invention as defined in the appended claims.

What is claimed is:

1. In a process for decarburization refining molten ferrous metal containing chromium, wherein said molten metal is decarburized by blowing gaseous oxygen onto or into said molten metal in a refining furnace provided with a top blowing lance having a plurality of gas blowing nozzles at the tip of the lance, the steps which comprise:

providing said gas blowing nozzles as (a) at least one sub-nozzle positioned at or near the lance axis and (b) a plurality of at least three main nozzles arranged at said lance outwardly of and substantially surrounding said sub-nozzle; said main nozzles having a greater blowing capacity than that of said sub-nozzle, and refining said molten metal by concurrently blowing with oxygen from said sub-nozzle and blowing a curtain extending substantially around the flow from said sub-nozzle from a plurality of said main nozzles, said blowing being performed at a main nozzle flow rate that is higher than the flow rate from said sub-nozzle.

2. The process according to claim 1, wherein oxygen flow from said sub-nozzle is directed in a generally axial direction or at an angle thereto for combustion of carbon monoxide gas formed from the molten metal, and wherein oxygen from said plurality of main nozzles is directed at an angle to said axial direction that is wider than the sub-nozzle angle.

3. The process according to claim 1, wherein the temperature of the molten metal is at least about 1,650° C. when the carbon content of said molten metal is about 1 wt % or more.

4. The process according to claim 2, wherein the temperature of the molten metal is at least about 1,650° C. when the carbon content of said molten metal is about 1 wt % or more.

5. The process defined in claim 1, wherein at least three of said main nozzles are provided in surrounding relationship to said sub-nozzle.

6. The process defined in claim 1, wherein the total cross-sectional area of said sub-nozzle is about 3% to about 30% of the total cross-sectional area of all of said nozzles.

* * * * *